US008132774B1

(12) United States Patent
Whatcott

(10) Patent No.: US 8,132,774 B1
(45) Date of Patent: Mar. 13, 2012

(54) CONCRETE FORMING SCREED AIDS

(76) Inventor: Douglas Whatcott, Los Altos, CA (US)

( * ) Notice: Subject to any disclaimer, the term of this patent is extended or adjusted under 35 U.S.C. 154(b) by 1204 days.

(21) Appl. No.: 11/787,754

(22) Filed: Apr. 17, 2007

Related U.S. Application Data

(60) Provisional application No. 60/792,469, filed on Apr. 17, 2006.

(51) Int. Cl.
*E04G 11/06* (2006.01)
*E01C 7/00* (2006.01)

(52) U.S. Cl. ..... 249/4; 249/34

(58) Field of Classification Search ..... 249/34, 249/208, 216, 3–5; 403/67, 236, 306, 362, 403/395
See application file for complete search history.

(56) References Cited

U.S. PATENT DOCUMENTS

| | | | | | |
|---|---|---|---|---|---|
| 595,196 | A | * | 12/1897 | Newman et al. | 211/34 |
| 1,028,294 | A | * | 6/1912 | Simpson | 249/4 |
| 1,029,674 | A | * | 6/1912 | Dunagin | 249/4 |
| 1,397,253 | A | * | 11/1921 | Jones | 249/5 |
| 1,518,149 | A | * | 12/1924 | Kay | 249/22 |
| 1,988,746 | A | * | 1/1935 | Neptune | 52/679 |
| 2,886,267 | A | * | 5/1959 | Beach, Sr. | 248/514 |
| 3,207,465 | A | * | 9/1965 | Papin | 249/34 |
| 3,228,679 | A | * | 1/1966 | Dees | 269/71 |
| 3,579,938 | A | * | 5/1971 | Hanson | 52/365 |
| 3,861,046 | A | * | 1/1975 | Arn | 33/405 |
| 4,657,249 | A | * | 4/1987 | Offutt | 473/485 |
| 4,765,106 | A | * | 8/1988 | Modrovich | 52/365 |
| D313,163 | S | | 12/1990 | Pace et al. | |
| D317,250 | S | | 6/1991 | Shook et al. | |
| 5,058,854 | A | * | 10/1991 | Bravo | 249/2 |
| D327,002 | S | | 6/1992 | Breen | |
| 5,231,713 | A | * | 8/1993 | McDonnell | 5/310 |
| 5,419,055 | A | * | 5/1995 | Meadows | 33/518 |
| 5,830,378 | A | * | 11/1998 | Butler | 249/18 |
| 6,273,636 | B1 | | 8/2001 | Johanpeter | |
| 6,309,135 | B1 | * | 10/2001 | Thomson et al. | 403/344 |
| 6,322,045 | B1 | | 11/2001 | Andros | |
| 6,378,819 | B1 | * | 4/2002 | Johnson | 248/214 |
| D475,470 | S | | 6/2003 | Oakley | |
| 6,588,164 | B1 | | 7/2003 | Moblo | |
| 7,621,097 | B2 | * | 11/2009 | Wilhour | 52/741.15 |
| 7,628,799 | B2 | * | 12/2009 | Richelsoph et al. | 606/250 |

* cited by examiner

*Primary Examiner* — Janet M Wilkens
(74) *Attorney, Agent, or Firm* — Montgomery Patent & Design, LLC; Robert C. Montgomery; Joseph T. Yaksich

(57) ABSTRACT

A residential and commercial construction aid comprises a specialized set of clamps and brackets and a system directed thereto for the rapid and accurate set up of perimeter screed forms during concrete forming processes. The specialized components of the present invention include: brackets comprising a tubular shaft affixed to "L"- or "J"-shaped brackets for attachment to the forms; screed rod clamps oriented in a variety of embodiments to anticipate varying installation requirements; and a "T"-handled screw. A unique installation method utilizing the components mentioned above with concrete forms and stakes is also provided.

20 Claims, 11 Drawing Sheets

CONCRETE FORMING SCREED AIDS

RELATED APPLICATIONS

The present invention was first described in and claims the benefit of U.S. Provisional Application No. 60/792,469, filed Apr. 17, 2006, the entire disclosures of which are incorporated herein by reference.

FIELD OF THE INVENTION

The present invention relates generally to a unique system and method for the rapid and accurate set up of perimeter screed forms during concrete forming processes and, more particularly, to said forms consisting of a specialized set of clamps, brackets forms and stakes.

BACKGROUND OF THE INVENTION

Poured concrete slabs, footers and walls are a common method of building and structure construction. They are relatively easy to build, cost-effective and very long lasting. However, they do require some work especially during the form building process to ensure accurate size, placement, and levelness, thus insuring the overall quality of the final product. Most often workers use wooden forms held in place by other wooden or metal stakes. Which such a process does work, they are very time consuming to cut, place and nail together. Also, the very act of fastening them together using nails often drives them out of alignment. Additionally, they are difficult to disassemble and very difficult to reuse, due to the numerous nail holes resulting even after a few times. Accordingly, there is a need for a means by which concrete forms can be constructed without the disadvantages as listed above. The development of the herein disclosed system and method fulfills this need.

The concrete forming aids and system are a series of components that aid in the construction of concrete forms for various applications. The aid is used in the construction of forms for footers, slabs, walls, steps and other similar concrete assemblies. The invention consists of four discrete components. The first one is an "L"-shaped apparatus that joins driven vertical rods and horizontal stability rods together. Such a device allows for the stability of concrete form assembly when producing footers stem walls or slab pours. The second one is a "T"-shaped apparatus that also connects vertical rods as well as multiple horizontal rods. The third one is a clamp that attaches to the vertical rods but provides a surface to connect to wooden form guides using nails or other fasteners. A thumbscrew mechanism makes it easy to adjust the form up and down thus providing extremely accurate placement. The fourth and final one is another clamp assembly that connects the horizontal rod to a drop that holds the form in place. All of these components are fastened together using conventional rods, stakes and similar items. The system allows for easy assembly and disassembly without tools and can be easily cleaned and reused for repeated use. The use of the innovative system and method provides not only for the easy construction of concrete forms for multiple applications in a manner that produces quality concrete structures at a minimal cost and time.

Several attempts have been made in the past to provide a concrete forming device that is easy to use and quick to set up. U.S. Pat. No. 6,588,164, issued in the name Moblo, a screed form stake having a cradle portion with a horizontal top surface. Unfortunately, the Moblo device does not provide the plurality of specialized brackets as in the present invention.

U.S. Pat. No. 6,322,045, issued in the name of Andros, teaches a rapid forming system for tilt-up pre-cast concrete wall panels, comprising a formboard support, a formboard, and a fastener. Unfortunately, the Andros device only teaches forming wall portions and does not provide means to aid in the forming of an entire concrete flooring system complete with stem walls.

U.S. Pat. No. 5,830,978, issued in the name of Buter, describes an assemblage which forms in-situ monolithic concrete slab-on grade foundations comprising a number of form members of light-gage cold-formed metal, squaring wires, coarsely-threaded stakes, and an overhead screed. The Butler device also does not provide means to interconnect specialized bracketry.

None of the prior art particularly describes such a system to set up screed forms during the pouring and setting of concrete.

SUMMARY OF THE INVENTION

In view of the foregoing disadvantages inherent in the prior art, the general purpose of the present invention is to provide a system for setting up of screed forms during concrete forming processes, configured to include all the advantages of the prior art, and to overcome the drawbacks of the prior art.

In a first aspect, the present invention provides a system for setting up of screed forms on a grade during concrete forming processes, comprising: a first vertical stake and a second vertical stake, a portion of the first vertical stake and the second vertical stake driven vertically into the grade; a first "L"-shaped bracket and a second "L"-shaped bracket; and a horizontal stake. Each "L"-shaped bracket comprises: a base; a side wall extending perpendicularly from the base, the side wall having a front side and a back side; a vertical stake sleeve having a body portion with a top open end portion and a bottom open end portion, the bottom end portion disposed above a vertical stake hole on the base and the vertical stake sleeve extending upwardly along and parallel to the front side of the side wall; a fastening receiver disposed about a hole on the body portion of the vertical stake sleeve; and a plurality of mounting holes on the side wall.

The vertical stake sleeve and the vertical stake hole of the first "L"-shaped bracket are capable of receiving therethrough the first vertical stake, and the vertical stake sleeve and the vertical stake hole of the second "L"-shaped bracket are capable of receiving therethrough the second vertical stake. The fastening receiver of the first "L"-shaped bracket is capable of receiving a first fastener for securing the first vertical stake to the vertical stake sleeve of the first "L"-shaped bracket at a first intermediate position and the fastening receiver of the second "L"-shaped bracket is capable of receiving a second fastener for securing the second vertical stake to the vertical stake sleeve of the second "L"-shaped bracket at a second intermediate position. The horizontal stake is perpendicularly secured to the first vertical stake at a position higher than the first intermediate position, and the second vertical stake at a position higher than the second intermediate position.

The mounting holes of the first "L"-shaped bracket are capable of receiving therethrough mounting fasteners for securing a first screed form to the back side of the side wall of the first "L"-shaped bracket and the mounting holes of the second "L"-shaped bracket are capable of receiving mounting fasteners for securing a second screed form to the back side of the side wall of the second "L"-shaped bracket, thereby setting the first screed form and the second screed form to configure a concrete pouring area therebetween.

In another aspect, the present invention provides a system for setting up of screed forms on a grade during concrete forming processes, comprising: a first vertical stake and a second vertical stake, a portion of the first vertical stake and the second vertical stake driven vertically into the grade; a first "J"-shaped bracket and a second "J"-shaped bracket; a first form clip and a second form clip; and a first horizontal stake and a second horizontal stake. Each "J"-shaped bracket comprises: a front side wall; a back side wall; an intermediate wall connecting the front and the back side walls to configure a top form receiving channel therebetween; a horizontal stake sleeve having a body portion with two opposite open end portions extending outwardly from an outer surface of the front side wall, such that one open end portion is disposed on the outer surface of the front side wall; and a fastening receiver disposed about a hole on the body portion of the horizontal stake sleeve. Each form clip comprises: two side walls, and an intermediate wall connecting the two side walls to configure a bottom form receiving channel therebetween.

The horizontal stake sleeve of the first "J"-shaped bracket is capable of receiving an end portion of the first horizontal stake, and the horizontal stake sleeve of the second "J"-shaped bracket is capable of receiving an end portion of the second horizontal stake. The fastening receiver of the first "J"-shaped bracket is capable of receiving a first fastener for securing the first horizontal stake to the horizontal stake sleeve of the first "J"-shaped bracket, and the fastening receiver of the second "J"-shaped bracket is capable of receiving a second fastener for securing the second horizontal stake to the horizontal stake sleeve of the second "J"-shaped bracket. The first horizontal stake is perpendicularly secured to the first vertical stake at a first intermediate position of the first vertical stake, and the second horizontal stake is perpendicularly secured to the second vertical stake at a second intermediate position of the second vertical stake.

The top form receiving channel of the first "J"-shaped bracket is capable of receiving a top portion of a first screed from, and the top form receiving channel of the second "J"-shaped bracket is capable of receiving a top portion of a second screed form. The bottom form receiving channel of the first form clip is capable of receiving a bottom portion of the first screed from, and the bottom form receiving channel of the second form clip is capable of receiving a bottom portion of the second screed form, thereby setting the first screed form and the second screed from to configure a concrete pouring area therebetween.

In another aspect, the present invention provides a system for setting up of screed forms on a grade during concrete forming processes, comprising: a first vertical stake and a second vertical stake, a portion of the first vertical stake and the second vertical stake driven vertically into the ground; a first "J"-shaped bracket and a second "J"-shaped bracket; a first form clip and a second form clip; and a horizontal stake. Each "J"-shaped bracket comprises: a front side wall; a back side wall; an intermediate wall connecting the front and the back side walls to configure a top form receiving channel therebetween; a vertical stake sleeve having a body portion with a top open end portion and a bottom open end portion, the vertical stake sleeve connecting to and extending along an outer surface of the front side wall; and a fastening receiver disposed about a hole on the body portion of the vertical stake sleeve. Each form clip comprises two side walls, and an intermediate wall connecting the two walls to configure a bottom form receiving channel therebetween.

The vertical stake sleeve of the first "J"-shaped bracket is capable of receiving therethrough the first vertical stake and the vertical stake sleeve of the second "J"-shaped bracket is capable of receiving therethrough the second vertical stake. The fastening receiver of the first "J"-shaped bracket is capable of receiving a first fastener for securing the first vertical stake to the first "J"-shaped bracket at a first intermediate position and the fastening receiver of the second "J"-shaped bracket is capable of receiving a second fastener for securing the second vertical stake to the second "J"-shaped bracket at a second intermediate position. The horizontal stake is perpendicularly secured to the first vertical stake at a position higher than the first intermediate position, and the second vertical stake at a position higher than the second intermediate position.

The top form receiving channel of the first "J"-shaped bracket is capable of receiving a top portion of a first screed from, and the top form receiving channel of the second "J"-shaped bracket is capable of receiving a top portion of a second screed form. The bottom form receiving channel of the first form clip is capable of receiving a bottom portion of the first screed from, and the bottom form receiving channel of the second form clip is capable of receiving a bottom portion of the second screed form, thereby setting the first screed form and the second screed form to configure a concrete pouring area therebetween.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1A:
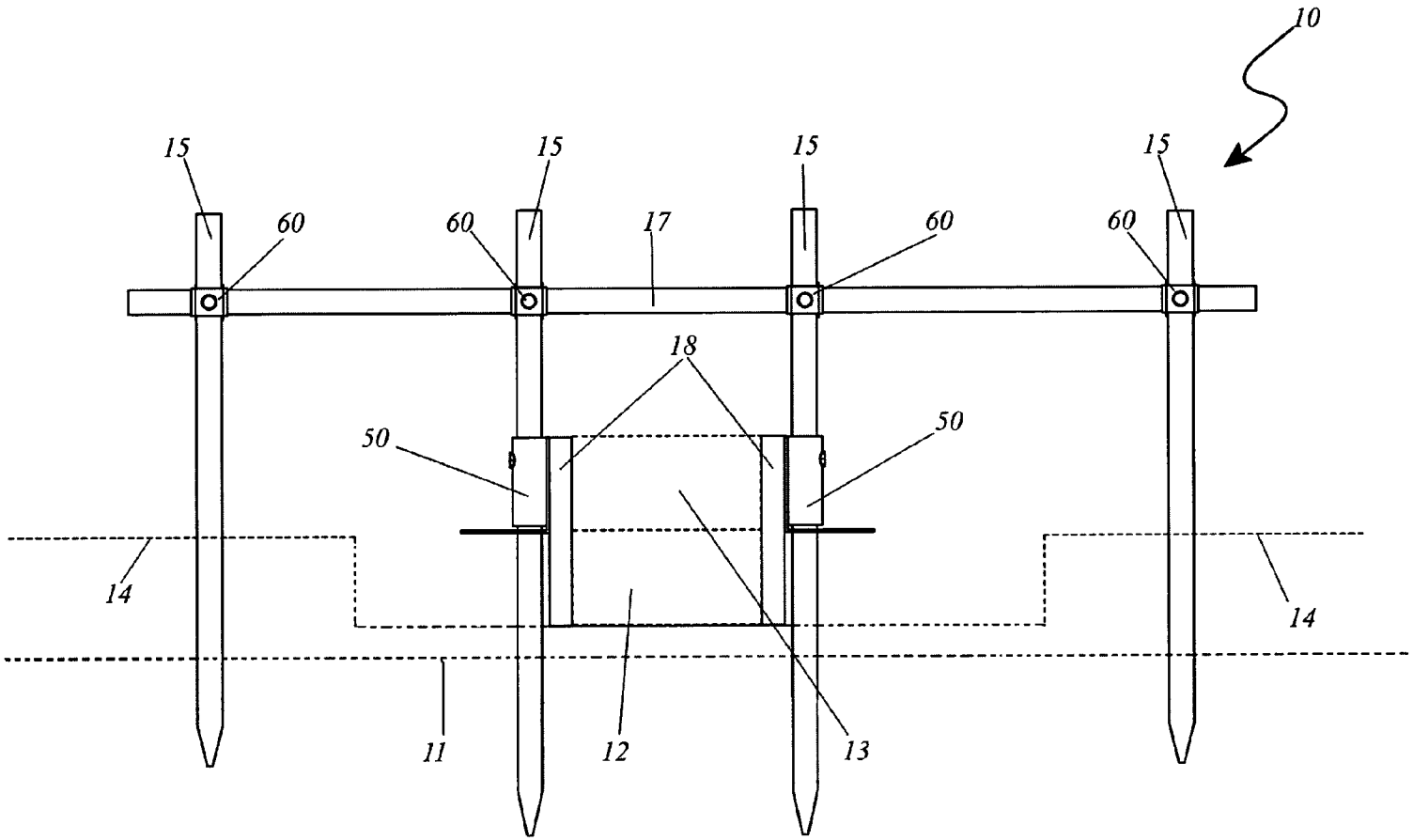
FIG. 1*a* is a front view of a concrete forming screed aid 10 for below-grade flooring applications, according to a preferred embodiment of the present invention; and, FIG. 1*b* is a close-up view of a 90 degree clamp 60 assembly portion of a concrete forming screed aid 10, according to a preferred embodiment of the present invention; and, FIG. 2*a* is a front view of a concrete forming screed aid 10 configured for stem wall formation applications, according to a preferred embodiment of the present invention; and, FIG. 2*b* is a close-up view of a "J"-shaped horizontal bracket assembly portion of a concrete forming screed aid, according to a preferred embodiment of the present invention; and, FIG. 2*c* is a perspective view of a quick form clip 90 portion of a concrete forming screed aid 10, according to a preferred embodiment of the present invention; and, FIG. 3 is a perspective view of an angle clamp 30 portion of a concrete forming screed aid 10, according to a preferred embodiment of the present invention; and, FIG. 4 is a perspective view of a "T"-screw 40 portion of a concrete forming screed aid 10, according to a preferred embodiment of the present invention; and, FIG. 5 is a perspective view of an "L"-shaped bracket 50 portion of a concrete forming screed aid 10, according to a preferred embodiment of the present invention; and, FIG. 6 is a perspective view of a 90 degree clamp 60 portion of a concrete forming screed aid 10, according to a preferred embodiment of the present invention; and, FIG. 7 is a perspective view of a vertical "J"-shaped bracket 70 portion of a concrete forming screed aid 10, according to a preferred embodiment of the present invention; and, FIG. 8 is a perspective view of a horizontal "J"-shaped bracket 70 portion of a concrete forming screed aid 10, according to a preferred embodiment of the present invention.

10 concrete forming screed aid
11 low grade
12 backfill
13 concrete floor
14 grade
15 vertical stake
16 stem wall
17 horizontal stakes
18 screed form
30 angle clamp
31 vertical stake hole
32 vertical stake support
33 angled stake hole
34 angled stake support
35 fastening receiver of "L"-shaped brackets
40 "T"-screw
41 threaded portion
42 elongated body
43 cap
50 "L"-shaped bracket
51 base mounting holes
52 fastening receiver
53 vertical stake sleeve
54 mounting holes on side wall
60 90 degree clamp
61 vertical stake hole
62 vertical stake support
63 horizontal stake hole
64 horizontal stake support
70 "J"-shaped bracket
71 back side wall of the "J"-shaped bracket
72 front side wall of the "J"-shaped bracket
73 vertical stake sleeve
74 fastening receiver
80 "J"-shaped bracket
81 back side wall of the "J"-shaped bracket
82 front side wall of the "J"-shaped bracket
83 horizontal stake sleeve
84 fastening receiver
90 form clip
91 upper clip portion
92 side clip portion

DETAILED DESCRIPTION OF THE PREFERRED EMBODIMENT

The best mode for carrying out the invention is presented in terms of its preferred embodiment, herein depicted within FIGS. 1 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a system and method for a concrete forming screed aid 10, which provides a means for a residential and commercial construction aid comprising a specialized set of clamps and brackets and a system directed thereto for the rapid and accurate set up of perimeter screed forms 18 during concrete forming processes. The specialized components of the present invention 10 include: a plurality of specialized brackets being affixed thereto various forms 18; various screed rod clamps oriented in a variety of embodiments to anticipate varying installation requirements; a "T"-handled screw 40 to secure said components in a variety of configurations; and a unique installation method utilizing the components mentioned above with concrete forms 18 and stakes 15 is also provided.

Referring now to FIG. 1*a*, a front view of the system 10 configured for below-grade flooring applications, according to the preferred embodiment of the present invention 10, is disclosed. The system 10 is illustrated in a configuration for a below-grade footer 13 depicting a number of the specialized clamps in use during a typical installation of a screed rod perimeter. The system 10 comprises a plurality of 90 degree clamps 60, a pair of "L"-brackets 50, a plurality of vertical stakes 15, and a horizontal brace 17.

Conventional screed rod stakes 15 are fed through the 90 degree clamps 60 and the "L"-shaped brackets 50 (see FIGS. 5 and 6) and driven into the grade 11, 14. A conventional tubular horizontal stake 17 provides a support means to the perimeter of the pour being attached also to said 90 degree clamps 60. The forms 18 are affixed to the system 10 via mechanical attachment of the "L"-shaped brackets 50 using fasteners such as nails or screws. The system 10 then receives backfill 12 and concrete 13.

Figure 1B:
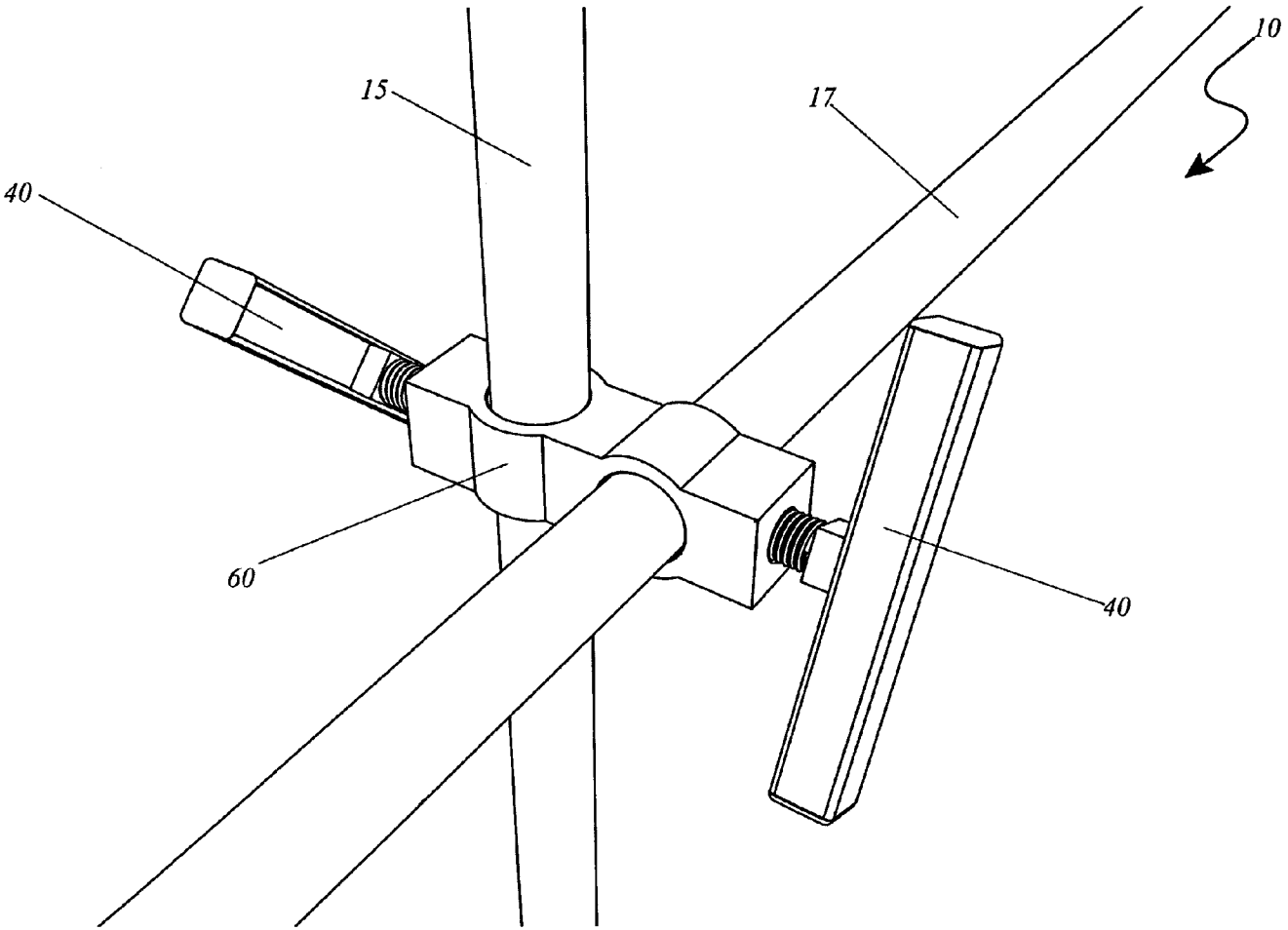

Referring now to FIG. 1*b*, a close-up view of a 90 degree clamp 60 assembly portion of the system 10, according to the preferred embodiment of the present invention, is disclosed. The system 10 comprises a 90 degree clamp 60, and a pair of "T"-screws 40. The 90 degree clamp 60 provides a slidingly adjustable positioning means to a horizontal stake 17 and a vertical stake 15 being held therein a relative vertical and horizontal position. The "T"-screws 40 provide a fastening means, thereby securing said components in position (see FIG. 4).

Figure 2A:
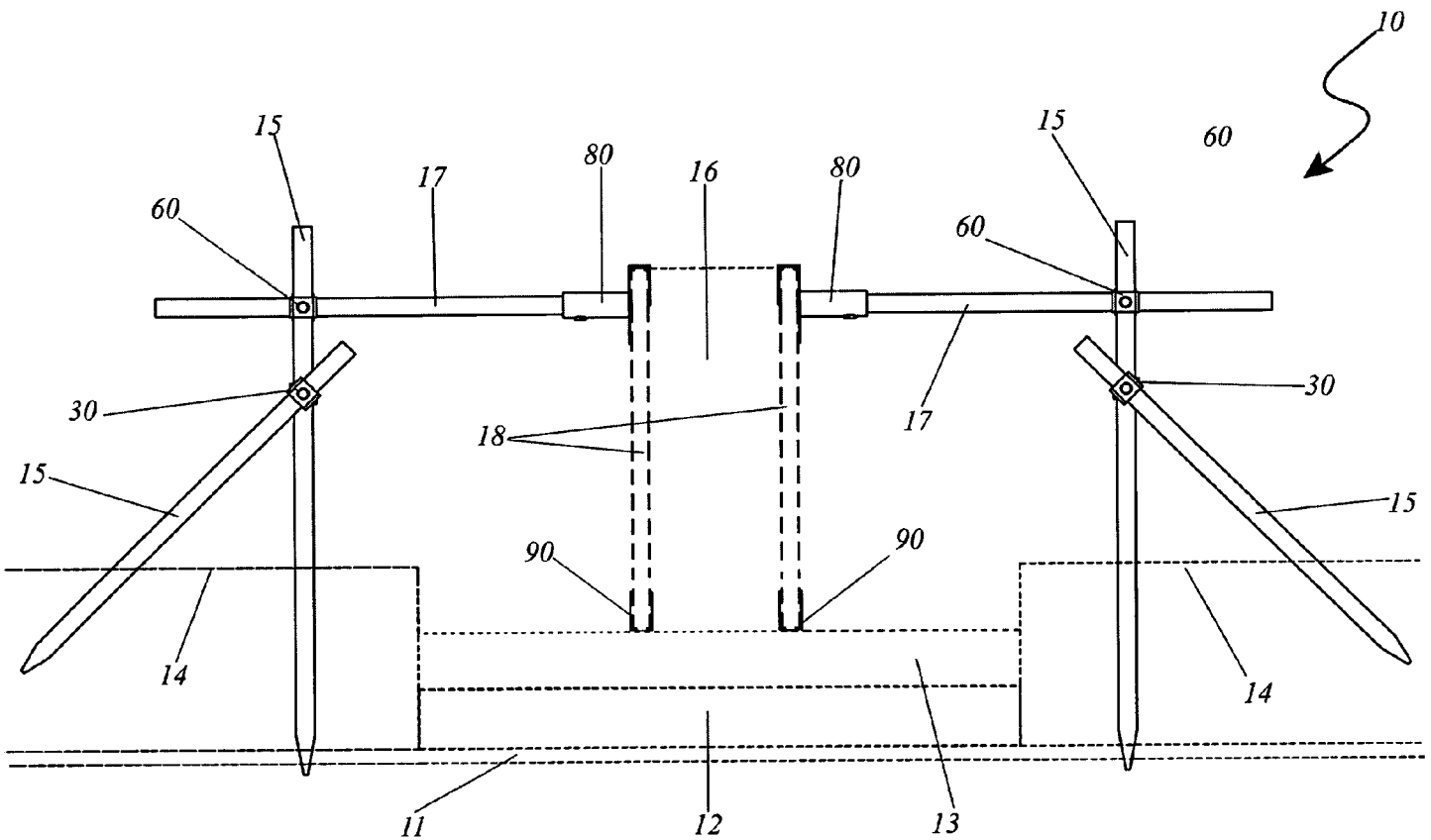

Referring now to FIG. 2*a*, a front view of the system 10 configured for stem wall formation applications, according to the preferred embodiment of the present invention, is disclosed. The system 10 as shown here illustrates a typical stem wall 16 forming configuration, comprising a pair of form clips 90, a pair of "J"-shaped brackets 80, a pair of angle clamps 30, a plurality of vertical stakes 15, and a horizontal stake 17.

Conventional screed rod stakes 15 are fed through the 90 degree clamps 60 and the angle clamps 30 (see FIGS. 3 and 6) and driven into the grade 11, 14. The "J"-shaped brackets 80 are attached to a top edge of the screed forms 18 providing an attachment means to conventional tubular horizontal stakes 17, thereby providing lateral support to the screed rod perimeter. The angle clamps 30 and the attached vertical stakes 15 provide an additional lateral support means to the apparatus 10. The apparatus 10 then receives backfill 12 and concrete 13, 16.

Figure 2B:
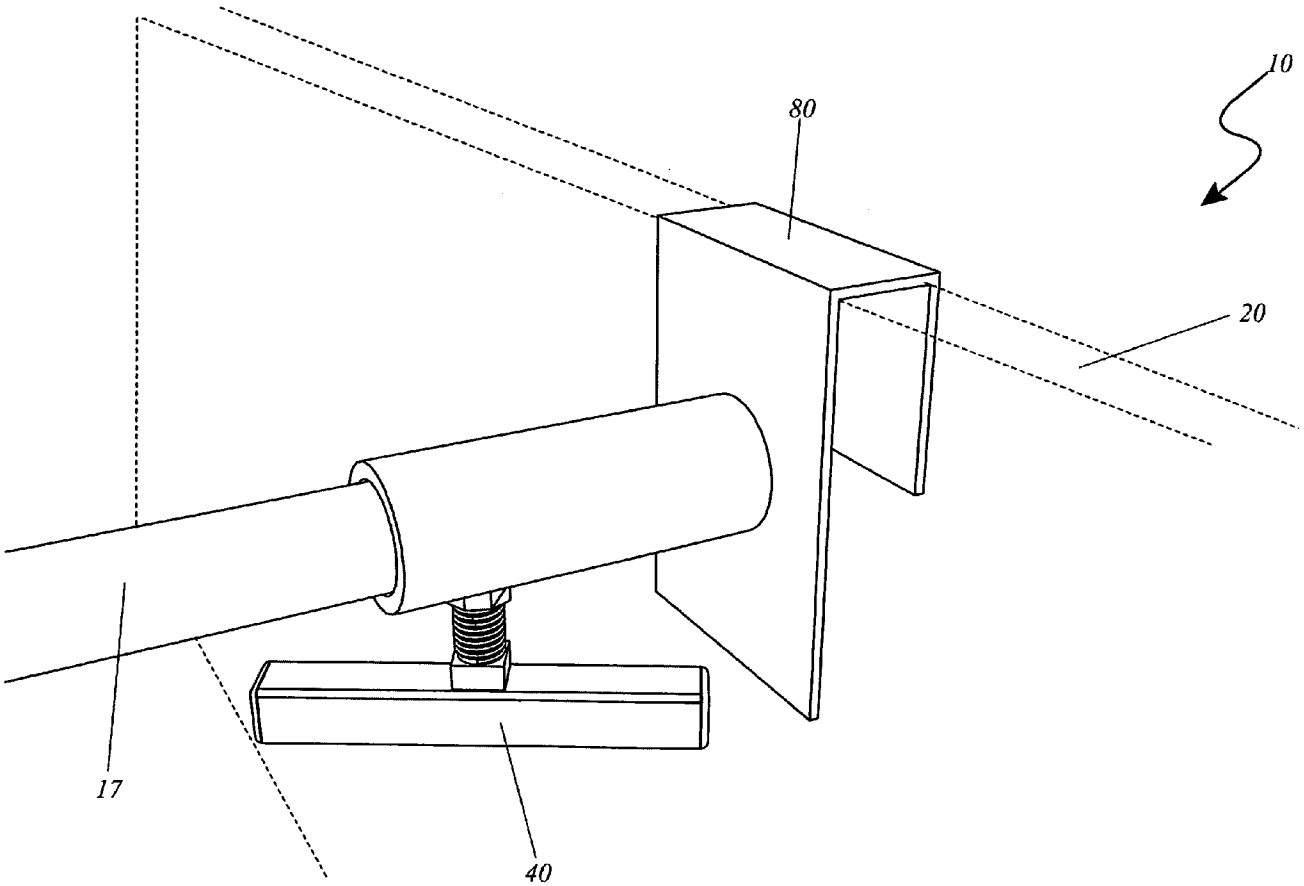

Referring now to FIG. 2*b*, a close-up view of a "J"-shaped bracket assembly portion of the system 10, according to the preferred embodiment of the present invention, is disclosed. The system 10 is illustrated here comprising a "J"-shaped bracket 80, a horizontal stake 17, and a "T"-screw 40. The "J"-shaped bracket 80 is affixed in a hooking manner to the top edge of a screed form 18 and a horizontal stake 17 installed therein. The "J"-shaped bracket 80 is locked securely to the horizontal stake 17 via a "T"-screw 40.

Figure 2C:
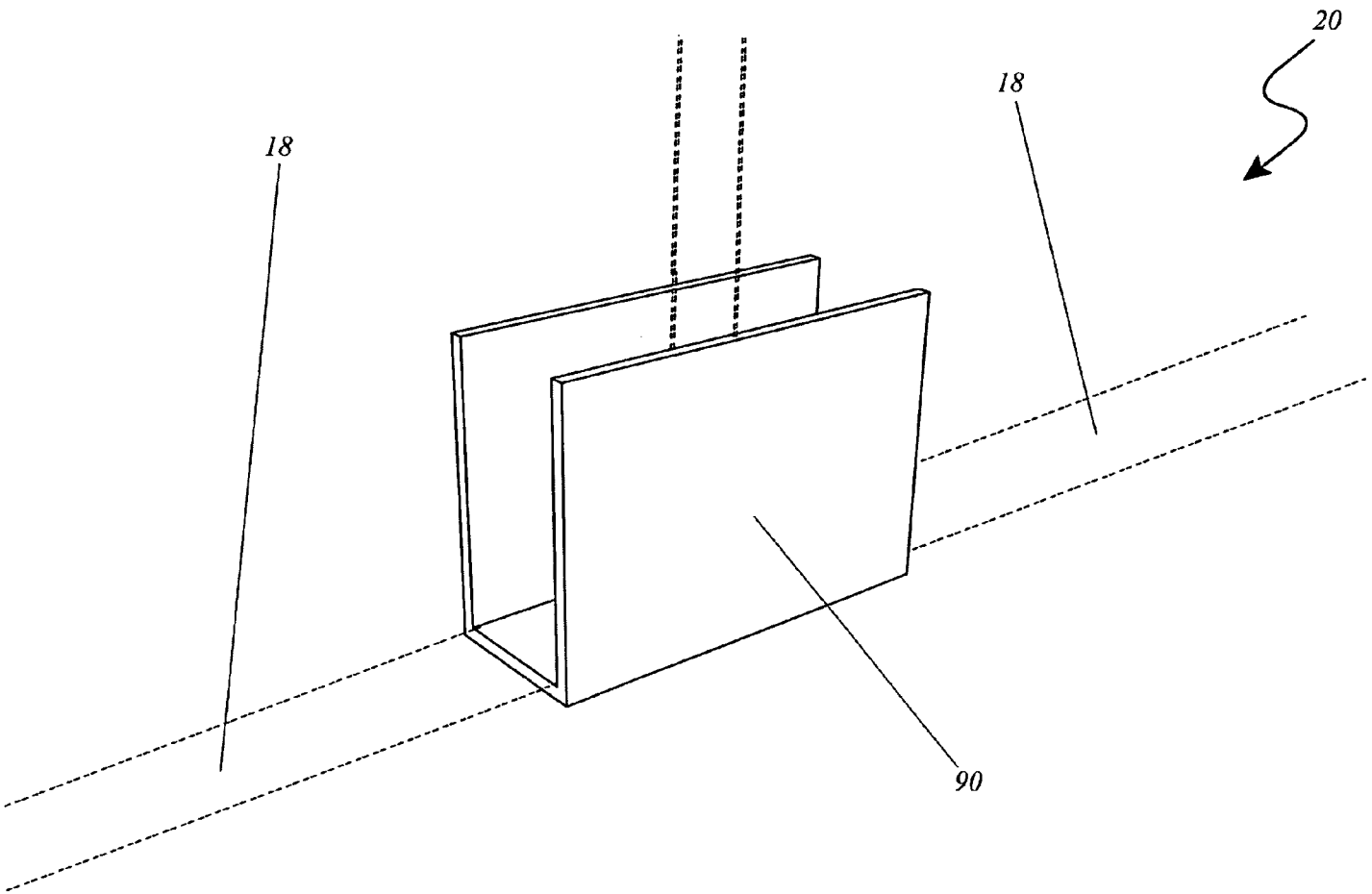

Referring now to FIG. 2*c*, a perspective view of a form clip 90 portion of the system 10, according to the preferred embodiment of the present invention, is disclosed. The form clip 90 comprises a heavy gauge sheet metal shape being formed in a "U" shape. The form clip 90 provides an alignment means to adjacent concrete form sections 18. The form clip 90 is sized to clip over a concrete screed 18 having a thickness of approximately two (2) inches to two-and-half (2½) inches.

Figure 3:
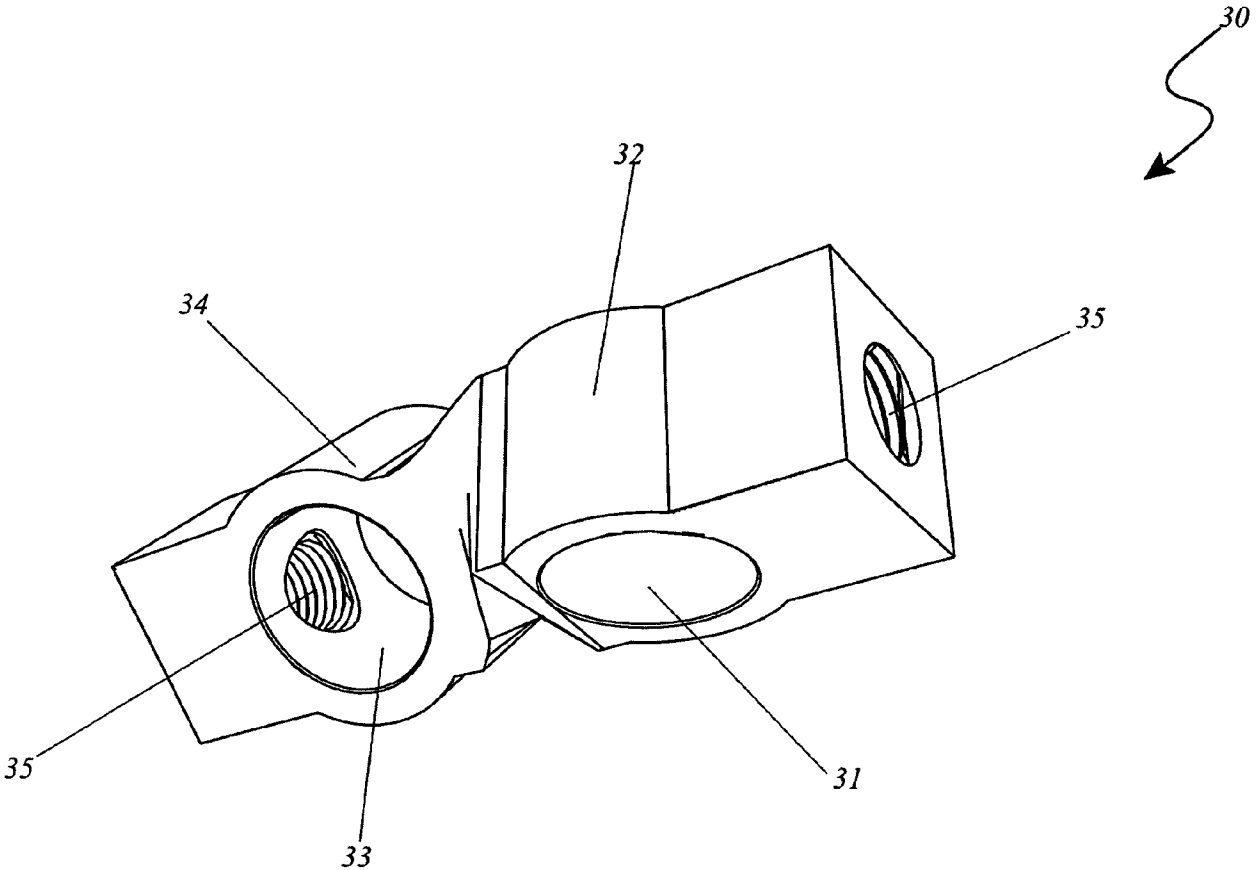

Referring now to FIG. 3, a perspective view of an angle clamp 30 portion of the system 10, according to the preferred embodiment of the present invention, is disclosed. The angle clamp 30 comprises a vertical stake hole 31, a vertical stake support 32, an angled stake hole 33, an angled stake support 34, and a pair of fastening receivers 35. The fastening receivers 35 may receive "L"-shaped brackets, "J"-shaped brackets, angle clamps, and 90 degree clamps. The vertical stake hole 31 is positioned in relation to the angled stake hole 33 being rotated 45 degrees about a horizontal axis. Each stake hole 31, 33 is formed therethrough and diametrically sized to receive a conventional vertical stake 15. The said stake holes 31, 33 are intersected by fastening receivers 35 formed in a wall portion of the vertical stake support 32 and the angled stake support 34. The fastening receivers provide a female threaded attachment means to "T"-screws 40 (see FIG. 4), thereby securing said angle clamp 30 thereon a vertical stake 15. The fastening receivers 35 are envisioned to provide a threaded thru-hole being located upon opposing side surfaces of the stake supports 32, 34.

Figure 4:
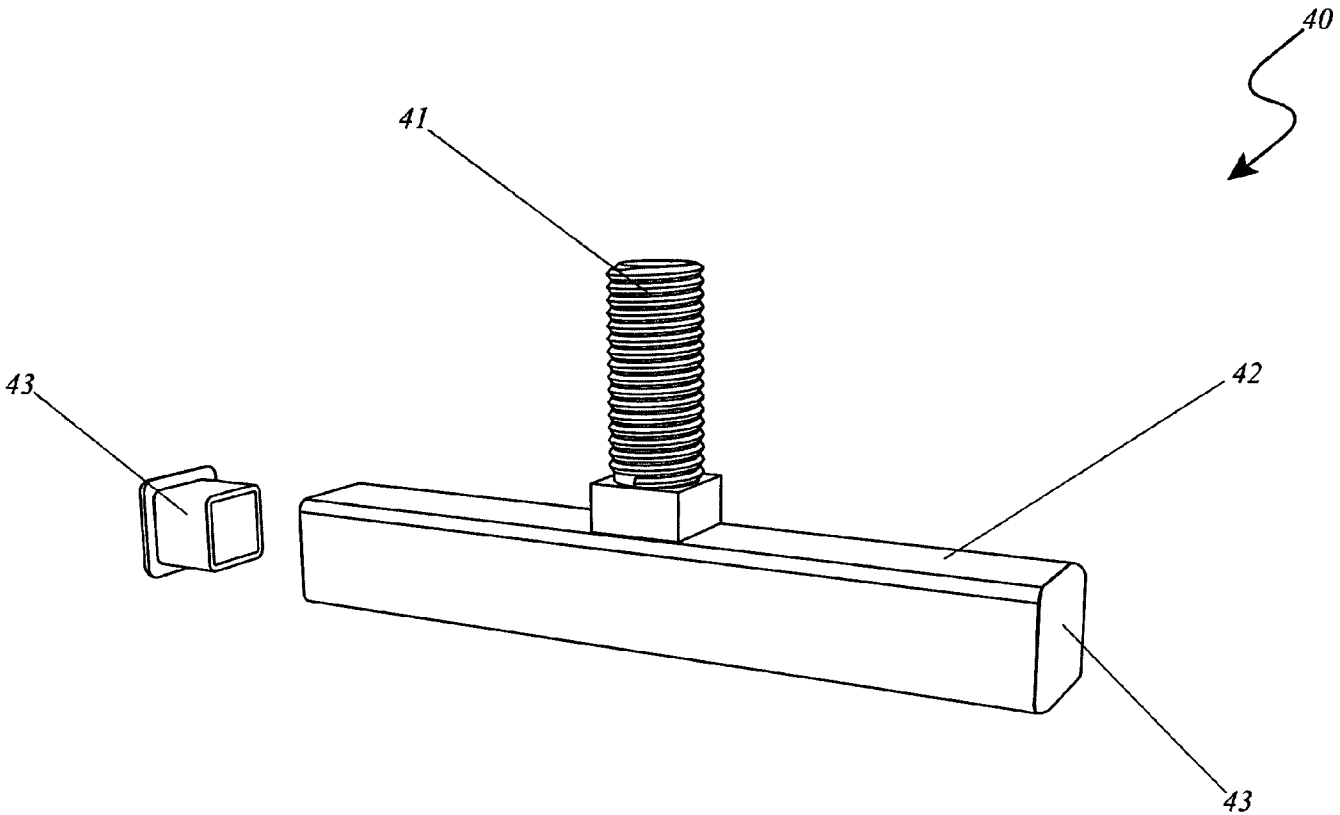

Referring now to FIG. 4, a perspective view of a "T"-screw 40 portion of the system 10, according to the preferred embodiment of the present invention, is disclosed. The "T"-screw 40 comprises a elongated body 42, a threaded portion 41, and a pair of plastic caps 43. The threaded portion 41 is mechanically affixed to an elongated body 42 via a welding process at an intermediate position and extends in an upward direction. The elongated body 42 is envisioned being made using square plated or painted steel tubing common in the industry. The threaded portion 41 provides an external thread with a corresponding diameter and pitch to those contained in the aforementioned fastening receiver 35. A pair of plastic protective caps 43 is sized accordingly and provides a plugging means to each open end of the elongated body 42.

Figure 5:
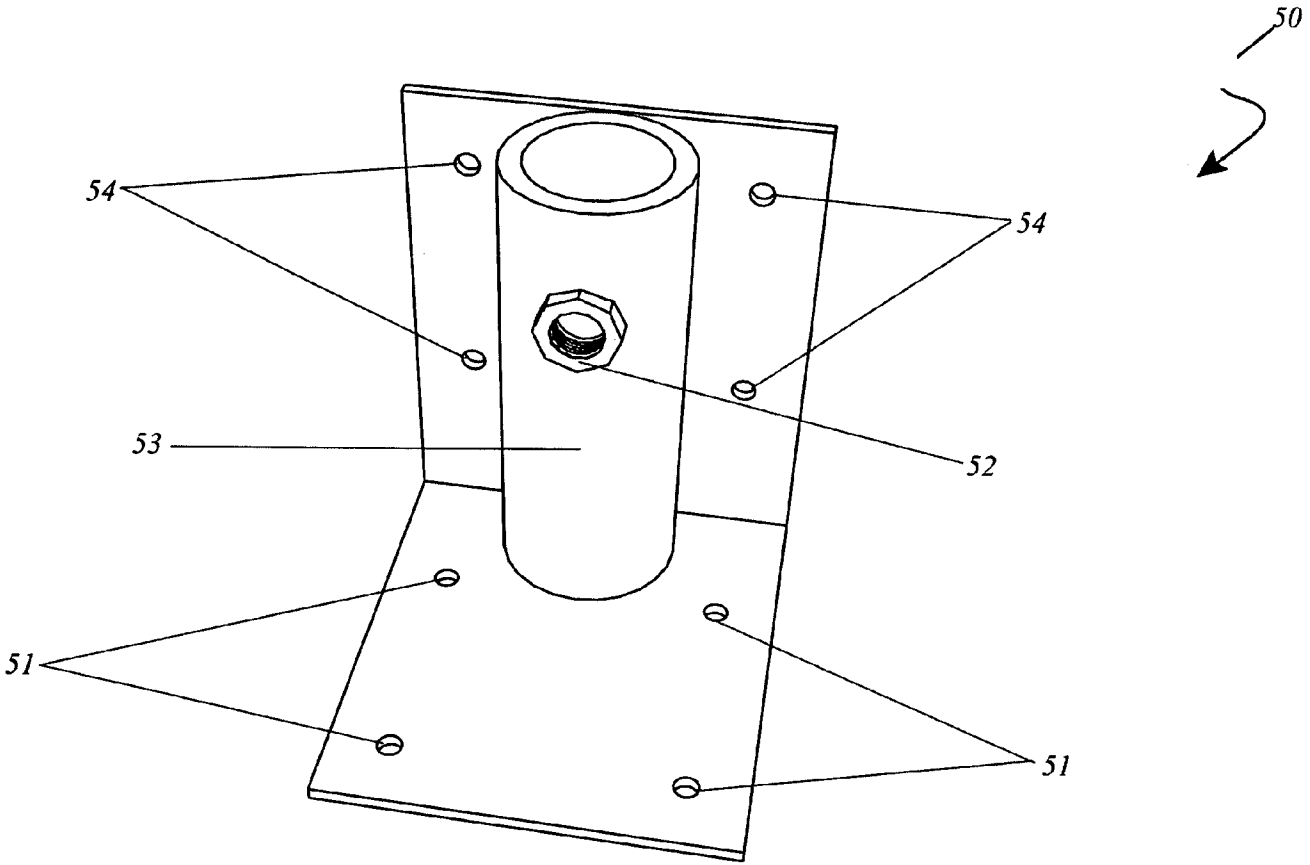

Referring now to FIG. 5, a perspective view of an "L"-shaped bracket 50 portion of the system 10, according to the preferred embodiment of the present invention, is disclosed. The "L"-shaped bracket 50 provides a mechanical attachment means to conventional screed forms 18 using fasteners such as nails or screws. The "L"-shaped bracket 50 comprises heavy gauge sheet metal formed in an "L"-shape with the base and back portion relatively equal in size. A plurality of base mounting holes 51 and side wall mounting holes 54 provide an attachment means to the screed forms 18 using fasteners such as nails or screws. A vertical stake sleeve 53 is welded parallel to and along the back portion of the bracket 50. The vertical stake sleeve 53 provides a tubular guiding means being diametrically sized to accept a vertical stake 15. The vertical stake sleeve 53 extends downward to a position almost abutting a base portion of the bracket 50. The base of the bracket 50 has a hole drilled therethrough directly beneath the vertical stake sleeve 53 and sized accordingly. A fastening receiver 52 is welded to the upper outer surface of the vertical stake sleeve 53 perpendicular to the back portion of the bracket 50.

Figure 6:
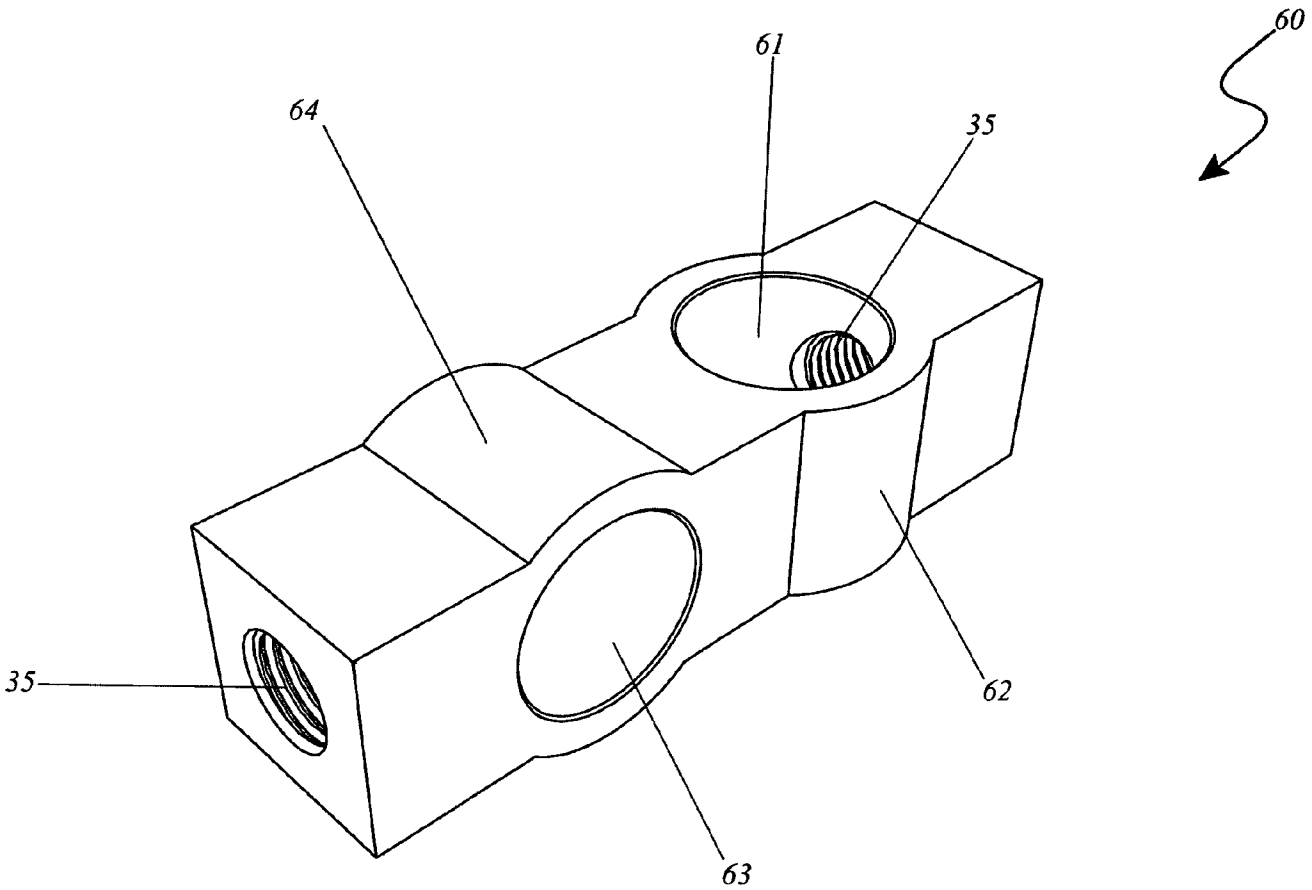

Referring now to FIG. 6, a perspective view of a 90 degree clamp 60 portion of the system 10, according to the preferred embodiment of the present invention, is disclosed. The 90 degree clamp 60 comprises a similar device as the aforementioned angle clamp 30 (see FIG. 3). A vertical stake hole 61 is oriented at a 90 degree rotation about a horizontal axis from a horizontal stake hole 63. The stake holes 61, 63 are sized to fit vertical stakes 15. A pair of fastening receivers 35 is formed in the ends of stake support portions 62, 64 being similar to those found in the angle clamp 30.

Figure 7:
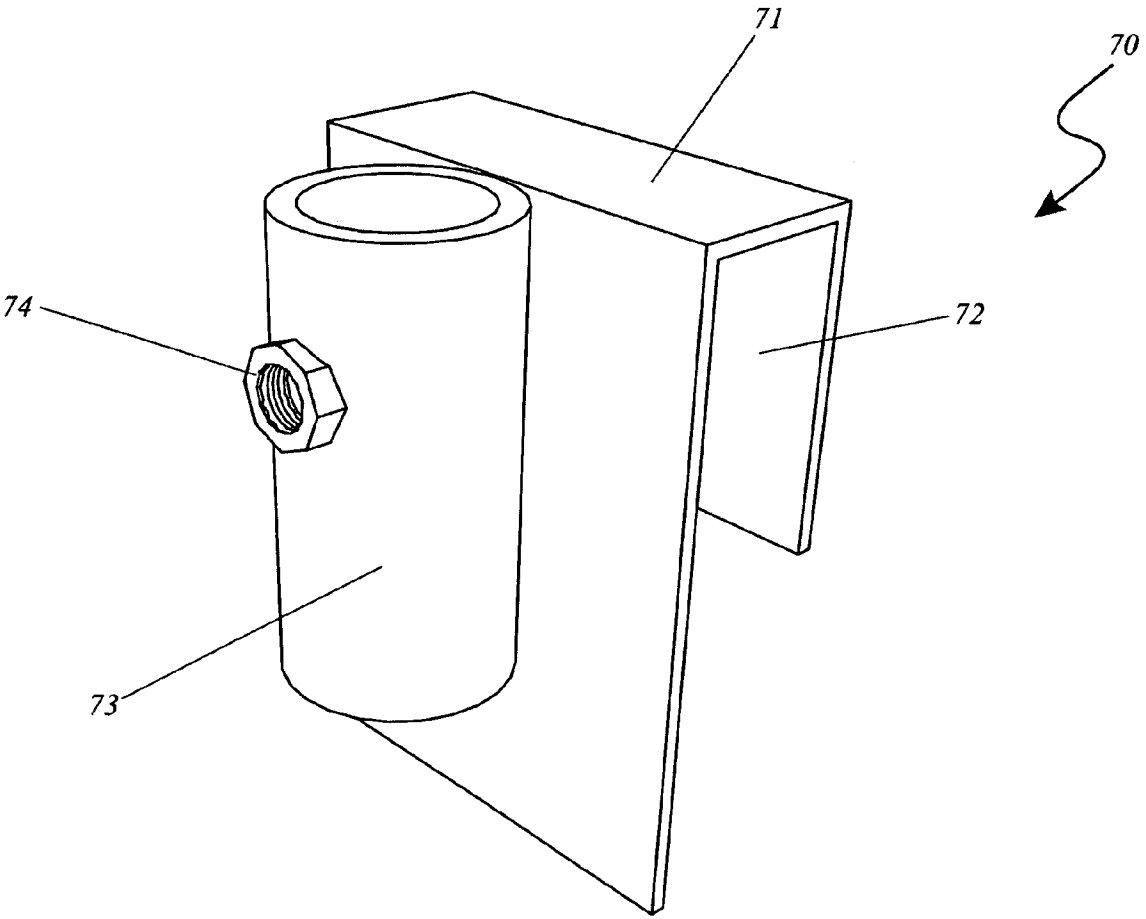

Referring now to FIG. 7, a perspective view of a vertical "J"-shaped bracket 70 portion of the apparatus 10 according to the preferred embodiment of the present invention is disclosed. The "J"-shaped bracket 70 comprises a heavy gauge sheet metal shape forming a "J"-shaped channel which provides an engaging means thereto a top edge of a screed form 18 as defined by the back side wall 71 of the "J"-shaped bracket 70 and front side wall 72 of the "J"-shaped bracket. The back side wall 71 is sized to clip over a concrete screed 18 having a thickness of approximately two (2) inches to two-and-half (2½) inches. The front side wall 72 extends downward, thereby providing a securing and stabilizing means to the "J"-shaped bracket 70. The "J"-shaped bracket 70 further comprises a stake sleeve 73 and a fastening receiver 74. The stake sleeve 73 is welded to the back portion of the "J"-shaped bracket 70. The stake sleeve 73 provides a tubular guiding means being diametrically sized to accept a vertical stake 15. The fastening receiver 74 is welded to said sleeve 73 directly opposite the back portion of the "J"-shaped bracket 70. The fastening receiver 74 provides an attachment means to a "T"-screw 40 (see FIG. 4).

Figure 8:
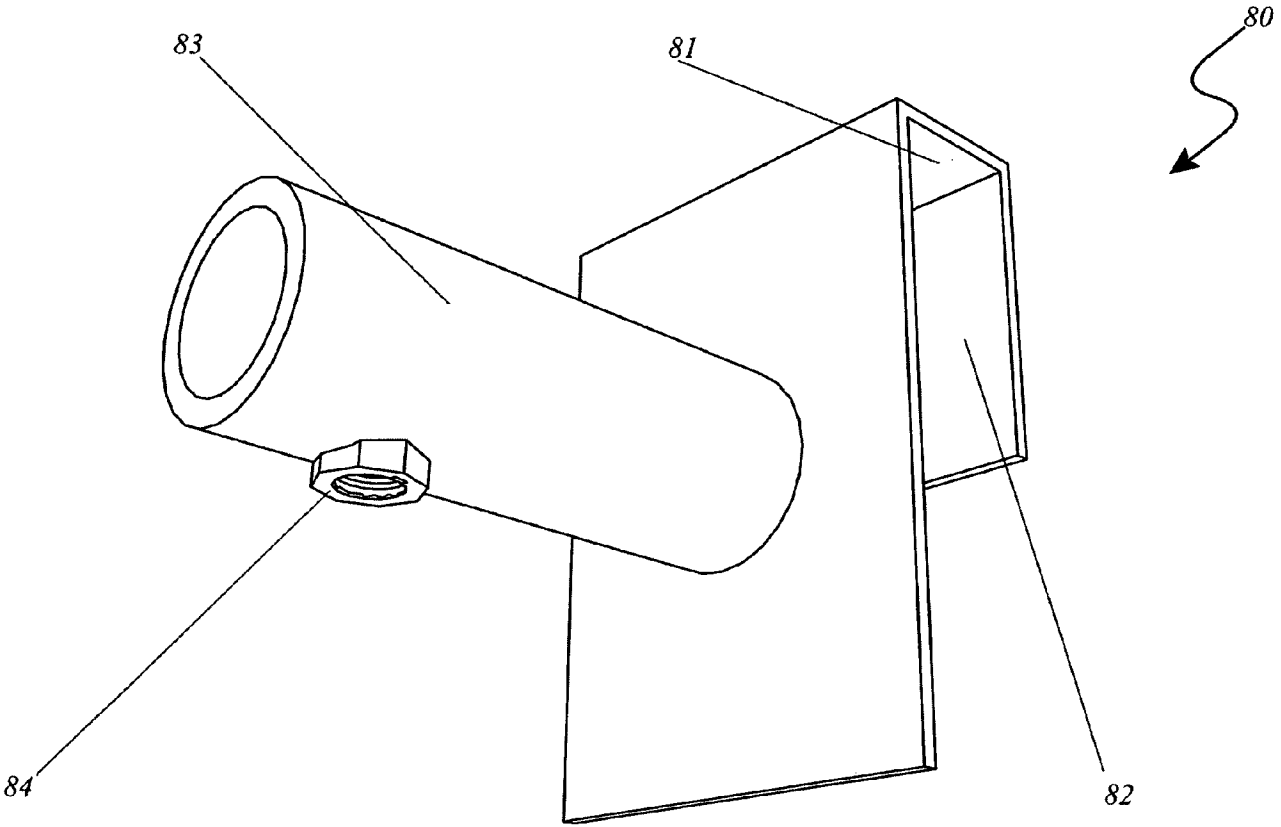

Referring now to FIG. 8, a perspective view of a "J"-shaped bracket 80 portion of the system 10, according to the preferred embodiment of the present invention, is disclosed. The "J"-shaped bracket 80 comprises a back side wall 81, a front side wall 82, a horizontal stake sleeve 83, and a fastening receiver 84. The back side wall 81 and front side wall 82 are formed and sized similar to that described in the vertical embodiment of the "J"-shaped bracket 70. The bottom of the horizontal stake sleeve 83 is welded perpendicular to the center of the back portion of the "J"-shaped bracket 80 opposite the front side wall 82. The horizontal stake sleeve 83 provides a tubular guiding means being diametrically sized to accept a vertical stake 15. A fastening receiver 84 is welded to the exterior wall of the horizontal stake sleeve 83 in a downward-facing orientation. The fastening receiver 84 provides an attachment means to a "T"-screw 40 (see FIG. 4).

All components of the present invention 10 are envisioned being manufactured using materials such as plated steel, painted steel, aluminum, or the like; however, alternate materials such as injection molded plastics, light-weight metal alloys, or the like may be provided and as such should not be considered a limiting factor of the invention.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by a normal person with some specialized concrete form preparation skills and minimal training. After initial purchase or acquisition of the system 10, it would be installed as indicated in FIGS. 1*a* and 2*a*.

The method of installing and utilizing the system 10 may be achieved by performing the following steps: driving a series of vertical stakes 15, thereby forming a screed rod perimeter for the proper and accurate pour of backfill 12, concrete floors 13, stem walls 16, slab pours, footers, concrete steps, and the like; determining grade points, elevations, and widths of subsequent concrete pours; spreading backfill 12 out along the entire pour area on the grade level 14 for slab pours or on the below grade level 11 for footers; mapping out the perimeter of the pour with screed forms 18; nailing or otherwise affixing specialized brackets to said forms 18 and inserting vertical stakes 15 through the stake sleeve portions 53, 73, 83 and then into the grade 11, 14; inserting a top portion of said stakes 15 through the angle clamps 30, or 90 degree clamps 60 depending on location; inserting horizontal stakes 17 into the 90 degree clamps 60 or the brackets 50, 70, 80 as required; installing "T"-screws 40 to assist in adjusting and stabilizing the height of the various components and tightening said "T"-screws 40 to secure the apparatus 10; completing the concrete pour and removing the apparatus 10 by loosening all "T"-screws 40, removing all horizontal stakes 17, removing all specialized brackets and vertical stakes 15; and, benefiting from the cost and time saving experienced when using the invention 10.

An alternate embodiment of the "J"-shaped brackets 70, 80 comprises said brackets 70, 80 being provided without fastening receivers 35 as said brackets 70, 80 provide a back side wall 71, 81 which wraps securely around a screed form 18 needing no additional mechanical attachment or fasteners.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A system for setting up of screed forms on a grade during concrete forming processes, comprising:

a first vertical stake and a second vertical stake, a portion of the first vertical stake and the second vertical stake driven vertically into a grade;

a first "J"-shaped bracket and a second "J"-shaped bracket, each comprising:

a front side wall, a back side wall, and an intermediate wall connecting the front and the back side walls to configure a top form receiving channel therebetween;

a horizontal stake sleeve having a body portion with two opposite open end portions, the horizontal stake sleeve extending outwardly from an outer surface of the front side wall, such that, one open end portion is disposed on the outer surface of the front side wall; and, a fastening receiver disposed about a hole on the body portion of the horizontal stake sleeve;

a first form clip and a second form clip, each comprising: two side walls, and an intermediate wall connecting the two side walls to configure a bottom form receiving channel therebetween; and, a first horizontal stake and a second horizontal stake;

wherein the horizontal stake sleeve of the first "J"-shaped bracket is capable of receiving an end portion of the first horizontal stake, and the horizontal stake sleeve of the second "J"-shaped bracket is capable of receiving an end portion of the second horizontal stake; and, wherein the fastening receiver of the first "J"-shaped bracket is capable of receiving a first fastener for securing the first horizontal stake to the horizontal stake sleeve of the first "J"-shaped bracket, and the fastening receiver of the second "J"-shaped bracket is capable of receiving a second fastener for securing the second horizontal stake to the horizontal stake sleeve of the second "J"-shaped bracket; and wherein the first horizontal stake is perpendicularly secured to the first vertical stake at a first intermediate position of the first vertical stake, and the second horizontal stake is perpendicularly secured to the second vertical stake at a second intermediate position of the second vertical stake; and, wherein the top form receiving channel of the first "J"-shaped bracket is capable of receiving a top portion of a first screed form, and the top form receiving channel of the second "J"-shaped bracket is capable of receiving a top portion of a second screed form; and, wherein the bottom form receiving channel of the first form clip is capable of receiving a bottom portion of the first screed form, and the bottom form receiving channel of the second form clip is capable of receiving a bottom portion of the second screed form, thereby setting the first screed form and the second screed from to configure a concrete pouring area therebetween.

2. The system of claim 1, wherein the first horizontal stake is perpendicularly secured to the first vertical stake and the second horizontal stake is perpendicularly secured to the second vertical stake using a first 90 degree clamp and a second 90 degree clamp respectively, each comprising:

a vertical stake support having a vertical stake hole;

a vertical stake fastening receiver;

a horizontal stake support having a horizontal stake hole; and, a horizontal stake fastening receiver;

wherein the vertical stake hole of the first 90 degree clamp is capable of receiving through the first vertical stake, and the vertical stake hole of the second 90 degree clamp is capable of receiving through the second vertical stake; and, wherein the vertical stake fastening receiver of the first 90 degree clamp is capable of receiving a third fastener for securing the first vertical stake to the vertical stake support of the first 90 degree clamp, and the vertical stake fastening receiver of the second 90 degree clamp is capable of receiving a fourth fastener for securing the second vertical stake to the vertical stake support of the second 90 degree clamp; and, wherein the horizontal stake hole of the first 90 degree clamp is capable of receiving through the first horizontal stake, and the horizontal stake hole of the second 90 degree clamp is capable of receiving through the second horizontal stake; and, wherein the horizontal stake fastening receiver of the first 90 degree clamp is capable of receiving a fifth fastener for securing the first horizontal stake to the horizontal stake support of the first 90 degree clamp, and the horizontal stake fastening receiver of the second 90 degree clamp is capable of receiving a sixth fastener for securing the second horizontal stake to the horizontal stake support of the second 90 degree clamp.

3. The system of claim 2, wherein the first, second, third, fourth, fifth, and sixth fasteners are "T"-screws, each "T"-screw comprising:

an elongated body; and, a threaded portion extending perpendicularly from the elongated body, the threaded portion engaging with a complementary threaded portion of one of the fastening receivers of the first and second "J"-shaped brackets, vertical stake fastening receivers of the first and second 90 degree clamps, and the horizontal stake fastening receivers of the first and second 90 degree clamps.

4. The system of claim 1, further comprising:

a first angled stake secured to the first vertical stake at a position lower than the first intermediate position, a portion of the first angled stake driven into the grade; and, a second angled stake secured to the second vertical stake at a position lower than the second intermediate position, a portion of the second angled stake driven into the grade.

5. The system of claim 4, wherein the first angled stake is secured to the first vertical stake and the second angled stake is secured to the second vertical stake using a first angle clamp and a second angle clamp respectively, each angle clamp comprising:

a vertical stake support having a vertical stake hole;

a vertical stake fastening receiver;

an angled stake support having an angled stake hole; and, an angled stake fastening receiver;

wherein the vertical stake hole of the first angle clamp is capable of receiving through the first vertical stake, and the vertical stake hole of the second angle clamp is capable of receiving through the second vertical stake;

wherein the vertical stake fastening receiver of the first angle clamp is capable of receiving a seventh fastener for securing the first vertical stake to the vertical stake support of the first angle clamp, and the vertical stake fastening receiver of the second angle clamp is capable of receiving an eighth fastener for securing the second vertical stake to the vertical stake support of the second angle clamp; and, wherein the angled stake hole of the first angle clamp is capable of receiving through the first angled stake, and the angled stake hole of the second angle clamp is capable of receiving through the second angled stake; and, wherein the angled stake fastening receiver of the first angle clamp is capable of receiving a ninth fastener for securing the first angled stake to the angled stake support of the first angle clamp, and the angled stake fastening receiver of the second angle clamp is capable of receiving a tenth fastener for securing the second angled stake to the angled stake support of the second angle clamp.

6. The system of claim 5, wherein the seventh, eighth, ninth, and tenth fasteners are "T"-screws, each "T"-screw comprising:

an elongated body; and, a threaded portion extending perpendicularly from the elongated body, the threaded portion engaging with a complementary threaded portion of one of the fastening receivers of the vertical stake fastening receivers of the first and second angle clamps, and the angled stake fastening receivers of the first and second angle clamps.

7. The system of claim 1, wherein the fastening receivers of the first and second "J"-shaped brackets are nuts, each nut comprising a threaded portion engaging with a complementary threaded portion of one of the first fastener or the second fastener.

8. The system of claim 1, further comprising:

a third vertical stake and a fourth vertical stake, a portion of the third vertical stake and the fourth vertical stake driven vertically into a grade;

a third "J"-shaped bracket and a fourth "J"-shaped bracket, each comprising:

a front side wall, a back side wall, and an intermediate wall connecting the front and the back side walls to configure a top form receiving channel therebetween;

a vertical stake sleeve having a body portion with a top open end portion and a bottom open end portion, the vertical stake sleeve connecting to and extending along an outer surface of the front side wall; and, a fastening receiver disposed about a hole on the body portion of the vertical stake sleeve;

a third form clip and a fourth form clip, each form clip comprising:

two side walls, and an intermediate wall connecting the two walls to configure a bottom form receiving channel therebetween; and, a third horizontal stake;

wherein the vertical stake sleeve of the third "J"-shaped bracket is capable of receiving through the third vertical stake and the vertical stake sleeve of the fourth "J"-shaped bracket is capable of receiving through the fourth vertical stake; and, wherein the fastening receiver of the third "J"-shaped bracket is capable of receiving a first fastener for securing the third vertical stake to the third "J"-shaped bracket at a first intermediate position and the fastening receiver of the fourth "J"-shaped bracket is capable of receiving a second fastener for securing the fourth vertical stake to the fourth J-shaped bracket at a second intermediate position; and, wherein the third horizontal stake is perpendicularly secured to the third vertical stake at a position higher than the first intermediate position, and the fourth vertical stake at a position higher than the second intermediate position; and, wherein the top form receiving channel of the third "J"-shaped bracket is capable of receiving a top portion of a third screed form, and the top form receiving channel of the fourth J-shaped bracket is capable of receiving a top portion of a fourth screed form; and, wherein the bottom form receiving channel of the third form clip is capable of receiving a bottom portion of the third screed form, and the bottom form receiving channel of the fourth form clip is capable of receiving a bottom portion of the fourth screed form, thereby setting the third screed form and the fourth screed form to configure a concrete pouring area therebetween.

9. The system of claim 8, wherein the third horizontal stake is perpendicularly secured to the third vertical stake and the fourth vertical stake using a first 90 degree clamp and a second 90 degree clamp respectively, each comprising:

a vertical stake support having a vertical stake hole;

a vertical stake fastening receiver;

a horizontal stake support having a horizontal stake hole; and, a horizontal stake fastening receiver;

wherein the vertical stake hole of the first 90 degree clamp is capable of receiving through the third vertical stake, and the vertical stake hole of the second 90 degree clamp is capable of receiving through the fourth vertical stake; and, wherein the vertical stake fastening receiver of the first 90 degree clamp is capable of receiving a third fastener for securing the third vertical stake to the vertical stake support of the first 90 degree clamp, and the vertical stake fastening receiver of the second 90 degree clamp is capable of receiving a fourth fastener for securing the fourth vertical stake to the vertical stake support of the second 90 degree clamp; and, wherein the horizontal stake holes of the first 90 degree clamp and the second 90 degree clamp are capable of receiving through the third horizontal stake; and, wherein the horizontal stake fastening receivers of the first and the second 90 degree clamps are capable of receiving a fifth fastener and a sixth fastener respectively for securing the third horizontal stake to the horizontal stake supports of the first and the second 90 degree clamps.

10. The system of claim 9, wherein the first, second, third, fourth, fifth, and sixth fasteners are "T"-screws, each "T"-screw comprising:

an elongated body; and, a threaded portion extending perpendicularly from the elongated body, the threaded portion engaging with a complementary threaded portion of one of the fastening receivers of said third and fourth "J"-shaped brackets, said vertical stake fastening receivers of the first and second 90 degree clamps, and the horizontal stake fastening receivers of the first and second 90 degree clamps.

11. The system of claim 8, further comprising:

a fifth vertical stake, a portion of the fifth vertical stake driven vertically into the grade, the fifth vertical stake perpendicularly secured to the third horizontal stake, such that, the third vertical stake is between the fourth and the fifth vertical stakes; and, a sixth vertical stake, a portion of the sixth vertical stake driven vertically into the grade, the sixth vertical stake perpendicularly secured to the third horizontal stake, such that, the fourth vertical stake is between the third and the sixth vertical stakes.

12. The system of claim 11, wherein the third horizontal stake is perpendicularly secured to the fifth vertical stake and the sixth vertical stake using a third 90 degree clamp and a fourth 90 degree clamp respectively, each comprising:

a vertical stake support having a vertical stake hole;

a vertical stake fastening receiver;

a horizontal stake support having a horizontal stake hole; and a horizontal stake fastening receiver;

wherein the vertical stake hole of the third 90 degree clamp is capable of receiving through the fifth vertical stake, and the vertical stake hole of the fourth 90 degree clamp is capable of receiving through the sixth vertical stake; and, wherein the vertical stake fastening receiver of the third 90 degree clamp is capable of receiving a seventh fastener for securing the fifth vertical stake to the vertical stake support of the third 90 degree clamp, and the vertical stake fastening receiver of the fourth 90 degree clamp is capable of receiving an eighth fastener for securing the sixth vertical stake to the vertical stake support of the fourth 90 degree clamp; and, wherein the horizontal stake holes of the third 90 degree clamp and the fourth 90 degree clamp are capable of receiving through the third horizontal stake; and, wherein the horizontal stake fastening receivers of the third and the fourth 90 degree clamps are capable of receiving a ninth and a tenth fastener respectively for securing the third horizontal stake to the horizontal stake support of the third and the fourth 90 degree clamps.

13. The system of claim 12, wherein the seventh, eighth, ninth, and tenth fasteners are "T"-screws, each "T"-screw comprising:

an elongated body; and, a threaded portion extending perpendicularly from the elongated body, the threaded portion engaging with a complementary threaded portion of one of the fastening receivers of the vertical stake fastening receivers of the third and fourth 90 degree clamps, and the horizontal stake fastening receivers of the third and fourth 90 degree clamps.

14. The system of claim 8, further comprising:

a fifth vertical stake and an sixth vertical stake, a portion of the fifth vertical stake and the sixth vertical stake driven vertically into a grade;

a first "L"-shaped bracket and a second "L"-shaped bracket, each comprising:

a base;

a side wall extending perpendicularly from the base, the side wall having a front side and a back side;

a vertical stake sleeve having a body portion with a top open end portion and a bottom open end portion, the bottom end portion disposed above a vertical stake hole on the base and the vertical stake sleeve extending upwardly along and parallel to the front side of the side wall;

a fastening receiver disposed about a hole on the body portion of the vertical stake sleeve; and, a plurality of mounting holes on the side wall; and, a fourth horizontal stake;

wherein the vertical stake sleeve and the vertical stake hole of the first "L"-shaped bracket are capable of receiving through the fifth vertical stake, and the vertical stake sleeve and the vertical stake hole of the second "L"-shaped bracket are capable of receiving through the sixth vertical stake; and, wherein the fastening receiver of the first "L"-shaped bracket is capable of receiving a first fastener for securing the fifth vertical stake to the vertical stake sleeve of the first "L"-shaped bracket at a first intermediate position and the fastening receiver of the second "L"-shaped bracket is capable of receiving a second fastener for securing the sixth vertical stake to the vertical stake sleeve of the second "L"-shaped bracket at a second intermediate position; and, wherein the fourth horizontal stake is perpendicularly secured to the fifth vertical stake at a position higher than the first intermediate position, and the sixth vertical stake at a position higher than the second intermediate position; and, wherein the mounting holes of the first "L"-shaped bracket are capable of receiving through mounting fasteners for securing a fifth screed form to the back side of the side wall of the first "L"-shaped bracket and the mounting holes of the second "L"-shaped bracket are capable of receiving mounting fasteners for securing a sixth screed form to the back side of the side wall of the second "L"-shaped bracket, thereby setting the fifth screed form and the sixth screed form to configure a concrete pouring area therebetween.

15. The system of claim 14, wherein the fourth horizontal stake is perpendicularly secured to the fifth vertical stake and the sixth vertical stake using a first 90 degree clamp and a second 90 degree clamp respectively, each comprising:

a vertical stake support having a vertical stake hole;

a vertical stake fastening receiver;

a horizontal stake support having a horizontal stake hole; and, a horizontal stake fastening receiver;

wherein the vertical stake hole of the first 90 degree clamp is capable of receiving through the fifth vertical stake, and the vertical stake hole of the second 90 degree clamp is capable of receiving through the sixth vertical stake; and, wherein the vertical stake fastening receiver of the first 90 degree clamp is capable of receiving a third fastener for securing the fifth vertical stake to the vertical stake support of the first 90 degree clamp, and the vertical stake fastening receiver of the second 90 degree clamp is capable of receiving a fourth fastener for securing the sixth vertical stake to the vertical stake support of the second 90 degree clamp; and, wherein the horizontal stake holes of the first 90 degree clamp and the second 90 degree clamp are capable of receiving through the fourth horizontal stake; and, wherein the horizontal stake fastening receivers of the first and the second 90 degree clamps are capable of receiving a fifth and a sixth fastener respectively for securing the fourth horizontal stake to the horizontal stake supports of the first and the second 90 degree clamps.

16. The system of claim 15, wherein the first, second, third, fourth, fifth, and sixth fasteners are "T"-screws, each "T"-screw comprising:

an elongated body; and, a threaded portion extending perpendicularly from the elongated body, the threaded portion engaging with a complementary threaded portion of one of the fastening receivers of the first and second "L"-shaped brackets, vertical stake fastening receivers of the first and second 90 degree clamps, and the horizontal stake fastening receivers of the first and second 90 degree clamps.

17. The system of claim 14, further comprising:

a seventh vertical stake, a portion of the seventh vertical stake driven vertically into the grade, the seventh vertical stake perpendicularly secured to the fourth horizontal stake such that the fifth vertical stake is between the sixth and the seventh vertical stakes; and a eighth vertical stake, a portion of the eighth vertical stake driven vertically into the grade, the eighth vertical stake perpendicularly secured to the fourth horizontal stake such that the sixth vertical stake is between the fifth and the eighth vertical stakes.

18. The system of claim 17, wherein the fourth horizontal stake is perpendicularly secured to the seventh vertical stake and the eighth vertical stake using a third 90 degree clamp and a fourth 90 degree clamp respectively, each 90 degree clamp comprising:

a vertical stake support having a vertical stake hole;

a vertical stake fastening receiver;

a horizontal stake support having a horizontal stake hole; and, a horizontal stake fastening receiver;

wherein the vertical stake hole of the third 90 degree clamp is capable of receiving through the seventh vertical stake, and the vertical stake hole of the fourth 90 degree clamp is capable of receiving through the eighth vertical stake; and, wherein the vertical stake fastening receiver of the third 90 degree clamp is capable of receiving a seventh fastener for securing the seventh vertical stake to the vertical stake support of the third 90 degree clamp, and the vertical stake fastening receiver of the fourth 90 degree clamp is capable of receiving an eighth fastener for securing the eighth vertical stake to the vertical stake support of the fourth 90 degree clamp; and, wherein the horizontal stake holes of the third 90 degree clamp and the fourth 90 degree clamp are capable of receiving through the fourth horizontal stake; and, wherein the horizontal stake fastening receivers of the third and the fourth 90 degree clamps are capable of receiving a ninth and a tenth fastener respectively for securing the fourth horizontal stake to the horizontal stake supports of the third and the fourth 90 degree clamps.

19. The system of claim 18, wherein the seventh, eighth, ninth, and tenth fasteners are "T"-screws, each "T"-screw comprising:

an elongated body; and, a threaded portion extending perpendicularly from the elongated body, the threaded portion engaging with a complementary threaded portion of one of the fastening receivers of the vertical stake fastening receivers of the third and fourth 90 degree clamps, and the horizontal stake fastening receivers of the third and fourth 90 degree clamps.

20. The system of claim 14, wherein the fastening receiver of the first and the second "L"-shaped brackets are nuts, each nut comprising a threaded portion engaging with a complementary threaded portion of one of the first fastener or the second fastener.

* * * * *